US008845563B2

(12) United States Patent
Tsai

(10) Patent No.: US 8,845,563 B2
(45) Date of Patent: Sep. 30, 2014

(54) MASSAGE DEVICE

(76) Inventor: Ming-Wei Tsai, Taipei Hsien (TW)

( * ) Notice: Subject to any disclaimer, the term of this patent is extended or adjusted under 35 U.S.C. 154(b) by 1394 days.

(21) Appl. No.: 12/327,574

(22) Filed: Dec. 3, 2008

(65) Prior Publication Data

US 2010/0137762 A1 Jun. 3, 2010

(51) Int. Cl.
*A61H 7/00* (2006.01)

(52) U.S. Cl.
USPC ..... 601/97; 601/101; 601/103; 601/89; 601/93

(58) Field of Classification Search
USPC ..... 601/84–134
See application file for complete search history.

(56) References Cited

U.S. PATENT DOCUMENTS 6,808,500 B1 * 10/2004 Cheng-Yi et al. ..... 601/99
8,147,435 B2 * 4/2012 Ferber et al. ..... 601/99
2006/0129072 A1 * 6/2006 Shin ..... 601/18
2009/0227915 A1 * 9/2009 Chiang ..... 601/115
2009/0270778 A1 * 10/2009 Wu et al. ..... 601/97
2009/0299238 A1 * 12/2009 Huang ..... 601/101

* cited by examiner

*Primary Examiner* — Valerie L Skorupa
(74) *Attorney, Agent, or Firm* — Birch, Stewart, Kolasch & Birch, LLP

(57) ABSTRACT

A massage device includes an outer housing, a first transmission mechanism, a second transmission mechanism, a massage seat and at least one massage unit. The first transmission mechanism drives the massage seat to reciprocate moving in the outer housing. The massage unit includes a sway arm having a hole at a center thereof to receive a sway wheel. One of side surfaces of the sway wheel is slanted. The second transmission mechanism drives the sway wheel to rotate and the slanted side surface of the sway wheel presses against the sway arm, thereby driving the sway arm to sway. Massage members are disposed on a top of the sway arm. Through reciprocating movement of the massage seat, swaying of the sway arm and spinning of the massage members, the massage device provides reciprocating pressing and kneading massages on a user's body.

17 Claims, 7 Drawing Sheets

MASSAGE DEVICE

BACKGROUND OF THE INVENTION

1. Field of the Invention

The present invention generally relates to a massage device, and more particularly to a massage device capable of providing reciprocating pressing and kneading massages on a user's body.

2. The Prior Arts

A conventional massage device includes two rotating elements moving along a path to achieve a massage action. The massage device has a worm shaft and two worm wheel respectively disposed at both sides of the worm shaft. The worm shaft drives the two worm wheels to rotate in opposing directions, which causes kneading elements slantedly mounted on each worm wheel to rotate and move along the path to provide a massage action. Usually, this kind of massage device is used for a neck massage module of a massage chair or an individual massage device. However, the disadvantage of the conventional massage device is that it can only provide a single kneading massage on a single region of the user's body.

SUMMARY OF THE INVENTION

A primary objective of the present invention is to provide a universal massage device that can massage on different regions of a user's body, such as legs, neck, back, etc.

Another objective of the present invention is to provide a massage device in which massage units are movable in user-settable moving range, so that a reciprocating massage action can be applied on different portions of the user's body.

Still another objective of the present invention is to provide a massage device that provides various types of massage actions, such as kneading, pressuring, etc.

Further still another objective of the present invention is to provide a massage device that can apply heat on a user's body and has a light-emitting ornamental appearance during operation.

To achieve the objectives mentioned above, a massage device according to an embodiment of the present invention comprises an outer housing and at least one massage unit assembled in the outer housing. The movement of the massage unit in the outer housing is accomplished by mounting a first transmission mechanism between the massage unit and a lower cover of the housing. The first transmission mechanism comprises a motor engaged with a series of gears to drive a screw rod in rotation, which in turn drives a massage seat in movement. Moreover, a restricting switch is disposed between the massage seat and the lower cover, so that the user can set up the course of the massage movement. Reciprocating massage actions can thereby be applied on the user's body.

In order to achieve pressing, kneading and other massage movement, a second transmission mechanism is mounted in the massage device, comprising a motor to drive a rotary axle in rotation. Moreover, the massage unit comprises at least one sway wheel assembled on the rotary axle. The sway wheel is received in a hole of a sway arm. The sway arm is further provided with massage balls thereon. During operation, the rotary axle drives the sway wheel in rotation, which in turn rotates relative to the sway arm to cause the sway arm to perform left/right swaying movements along the axle direction. This swaying movement combined with a spinning movement of the massage balls disposed in the sway arm produces pressing and kneading massage actions that are applied on the user's body put in contact with the massage device.

The massage device according to the present invention can provide a massage action on various regions of the user's body.

To provide heat and a light-emitting ornamental effect, a lamp circuit and thermal resistor may be mounted in the sway arm. Moreover, the massage members (massage balls) and sway arm can be made of a material that is highly pervious to light. During operation, the thermal resistor produces heat that is applied on the user's body, and the light-emitting element produces light that is transmitted, amplified and scattered though the massage balls to provide a vivid ornamental effect.

The massage device according to the present invention has the following advantages:

1. The massage device according to the present invention includes two motors, one of which is configured to drive the massage seat to move, the other one being configured to drive the massage unit to massage. Thus, the massage device provides multiple modes of massage actions.

2. The configuration of the sway wheel causes the sway arm (including the massage balls) to perform horizontal swaying movements, thereby producing a massage action that combines kneading and pressing.

3. The course length of the reciprocating movement performed by the massage seat can be adjusted.

4. The massage device produces an effective massage action, has a compact structure, and is highly reliable.

5. The massage actions are provided by the multiple massage balls. Thus the massage actions are gentle and natural.

6. A vivid ornamental appearance can be rendered through the use of the light-emitting element. The sway arm and the massage balls are made of a material that is highly pervious to light, which are adapted to transmit, amplify and scatter light.

7. As the sway arm produces a vivid light effect, the aesthetic appearance of the massage device is improved.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
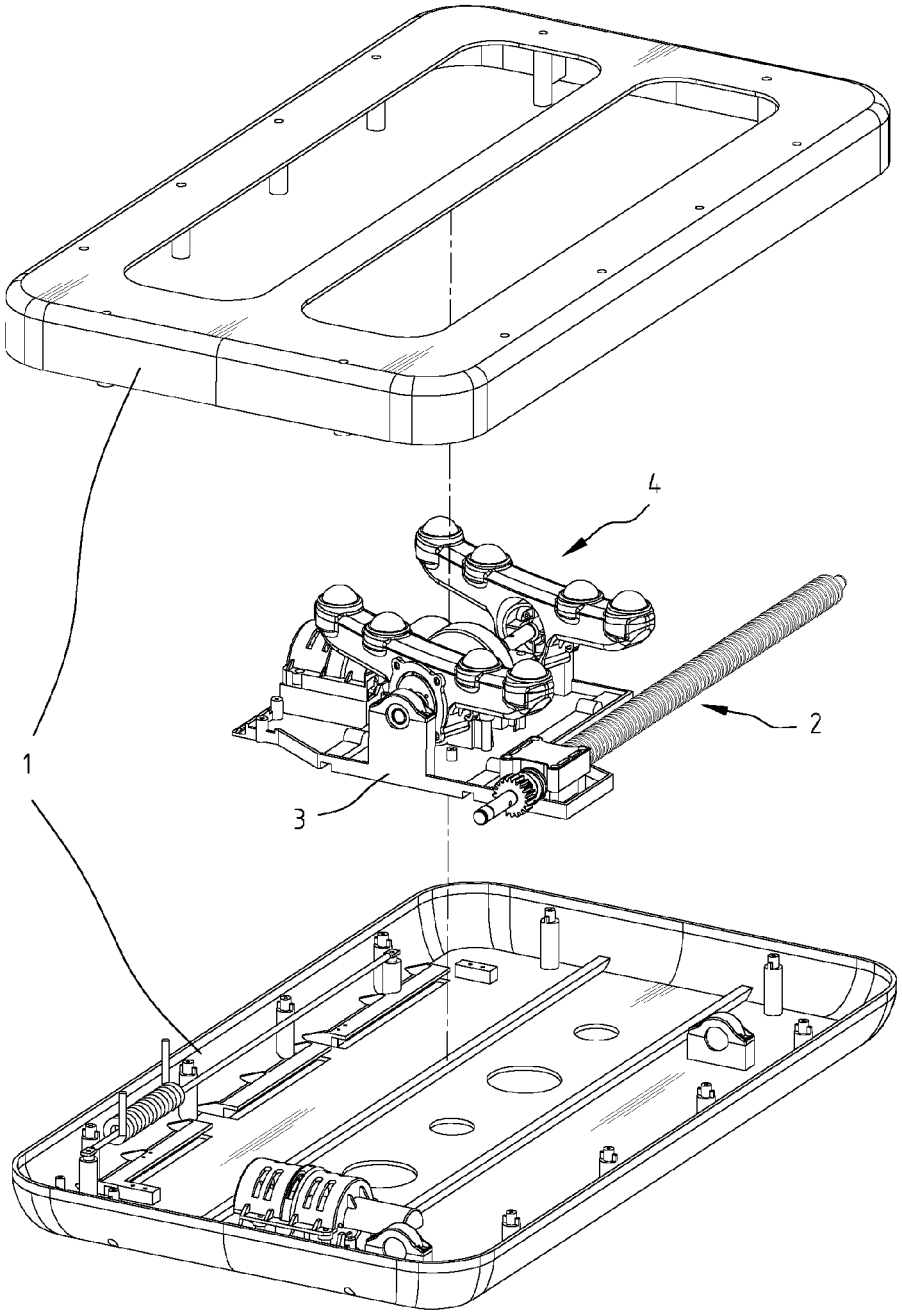
FIG. 1 is an exploded view showing a massage device according to an embodiment of the present invention.

Referring to FIG. 1, a massage device according to an embodiment of the present invention comprises an outer housing 1, a first transmission mechanism 2, a massage seat 3, a second transmission mechanism 5 and at least one massage unit 4. The first transmission mechanism 2, the second transmission mechanism 5 and the massage seat 3 are received in the outer housing 1. The first transmission mechanism 2 drives the massage seat 3 to reciprocate in the outer housing 1, and the second transmission mechanism 5 drives the massage unit 4 mounted on the massage seat 3 to massage a user's body.

Referring to FIGS. 2 to 5, the outer housing 1 includes an upper cover 11 and a lower cover 12. The upper cover 11 has at least one opening 11. The openings 111 are not limited to any specific shapes or number. The lower cover 12 includes two sliding tracks 121. A pair of screw rod supporting brackets 122 are disposed on an inner surface of the lower cover 12 adjacent to one of the sliding tracks 121. A motor supporting bracket 123 is also provided at an end region of the inner surface of the lower cover 12. The inner surface of the lower cover 12 is also mounted with a microcontroller (not shown) and a plurality of first contact tabs 124 spaced apart from one another. The first contact tabs 124 are limited in number. In this embodiment, three of the contact tabs are provided. The massage seat 3 is movably mounted on the sliding tracks 121.

The first transmission mechanism 2 according to the present embodiment comprises a motor 21 mounted on the motor supporting bracket 123. An axle of the motor 21 is coupled with a worm shaft 211. A screw rod 22 is mounted on the screw rod supporting brackets 122. A screw nut 221 having an inner thread is engaged with the screw rod 22 and connected with the massage seat 3. One end of the screw rod 22 is mounted with a transmission gear 222 that is engaged with the worm shaft 211. The first transmission mechanism 2 may be of any structures adapted to drive reciprocating movement of the massage seat 3 in the outer housing 1. For example, the screw rod 22 may be replaced by a rack engaged with a pinion. Then, the rack can drive the massage seat 3 to move.

The second transmission mechanism 5 comprises a rotary axle 51. The second transmission mechanism 5 may be of any structures adapted to drive the rotary axle 51 to rotate. The second transmission mechanism 5 according to the embodiment of the present invention also includes a motor 52 mounted on the massage seat 3. An axle of the motor 52 is coupled with a worm shaft 53 that is in engagement with a dual gear 54 mounted on the massage seat 3. The dual gear 54 engages with a transmission gear 55 assembled on the rotary axle 51.

The massage unit 4 is not limited in number. In the present embodiment, two massage units 4 are provided. Each massage unit 4 comprises a sway wheel 41 assembled on the rotary axle 51, and a sway arm 42 having a circular hole 421 configured to accommodate the sway wheel 41. Two side surface of the sway wheel 41 are not parallel to each other. Instead, one of the side surfaces of the sway wheel 41 is slanted. A circumferential surface of the hole 421 extends an inner ridge corresponding to the sway wheel 41. A lower end of the sway arm 42 receives the insertion of a positioning rod 43, and the positioning rod 43 has a free end rotatably inserted in a guide slot 441. The guide slot 441 may be either provided on a piece 44 that is mounted on the massage seat 3 or directly provided on the massage seat 3 (not shown). The sway arm 42 has a hollow structure that has an interior adapted to accommodate a plurality of massage members 45. The sway arm 42 also includes a cover 422 provided with a plurality of restricting openings 4221 through which the massage members 45 expose outward. The massage members 45 are not limited in structure. Each massage member 45 may be designed as, for example, an elongated body having a top rounded protrusion, or a massage head having an angled shape (not shown). In the present embodiment, the massage member 45 is formed as a massage ball made of a material that is highly pervious to light. The massage member 45 may also be made of a transparent material or a translucent material. The interior of each sway arm 42 accommodates at least one lamp circuit 46 and a thermal resistor (not shown). In this embodiment, the lamp circuit 46 includes a circuit board electrically connected with a light-emitting element 461 and the thermal resistor. The light-emitting elements 461 can be miniature lamps. Moreover, a side of the massage seat 3 is mounted with a plurality of second contact tabs 47 spaced apart from one another.

Referring to FIGS. 2 to 6, when the massage device is powered on, the two motors 21 and 52 are driven in rotation. The axle of the motor 21 drives the worm shaft 211 to rotate. Driven by the movement of the worm shaft 211, the transmission gear 222 causes the screw rod 22 to rotate and the screw nut 221 to translate relative to the screw rod 22. As a result, the massage seat 3 coupled with the screw nut 221 moves along a direction of the sliding tracks 121. In the course of movement, when the predetermined first contact tabs 124 on the inner surface of the lower cover 12 come in contact with the predetermined second contact tabs 47 on the massage seat 3, the microcontroller produces a switching signal to reverse the rotation of the motor 21. As a result, the first transmission mechanism 2 reversely operates to cause the massage seat 3 to move in the opposite direction. The user can set up the predetermined first contact tabs 124 and the second contact tabs 47. Therefore a course length of the massage seat 3 is adjustable. The massage device according to the present invention can massage user's body portions with different lengths, such as neck, leg, thigh, upper back, lower back and whole back.

Figure 3:
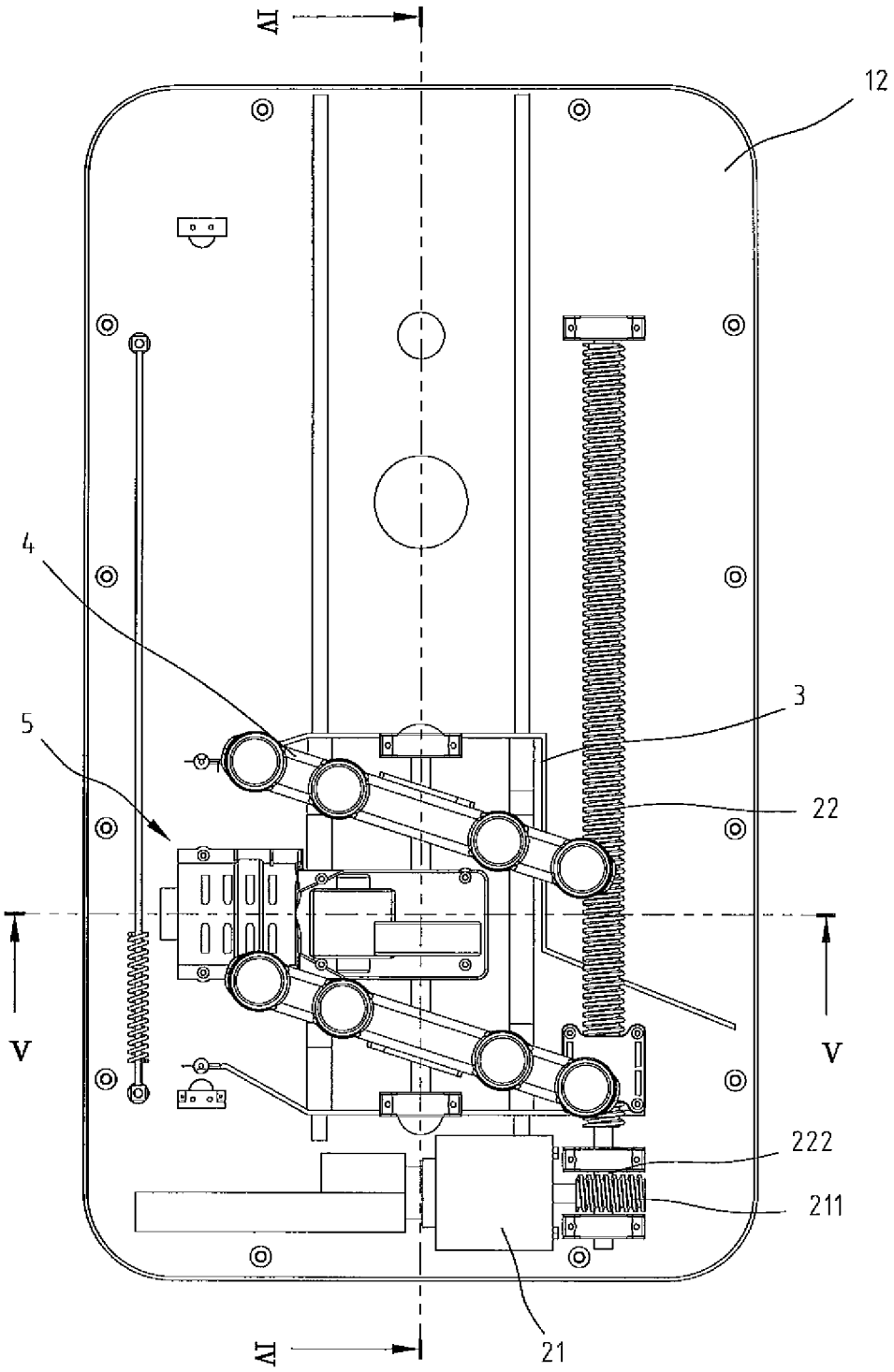
FIG. 3 is a top view of the massage device in an assembled state.
Figure 4:
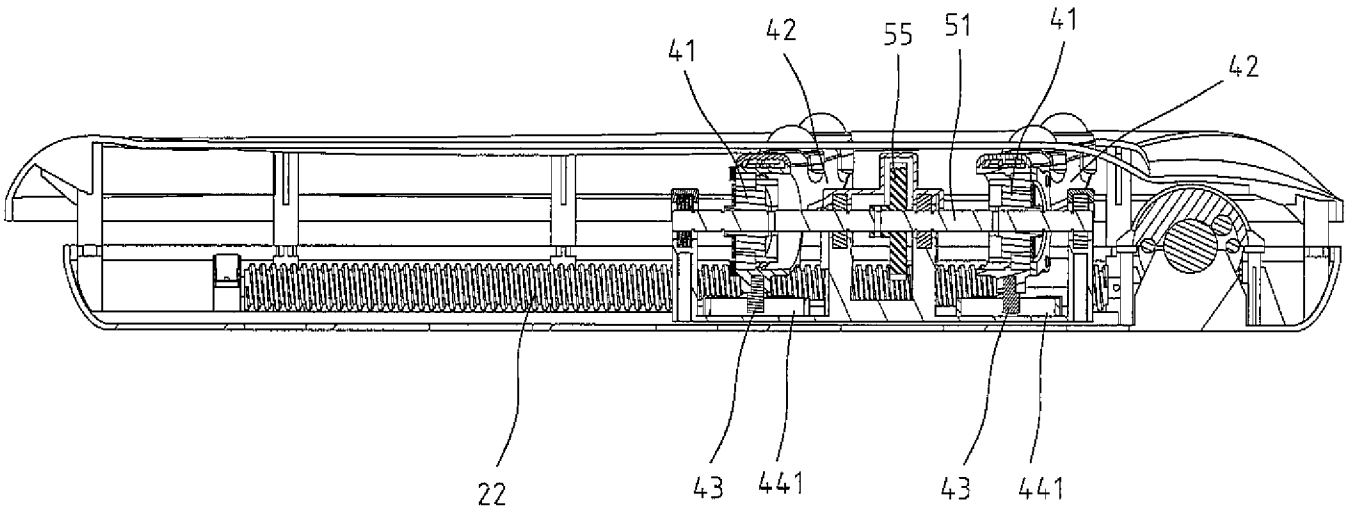
FIG. 4 is a cross-sectional view taken along line IV-IV in FIG. 3 showing the massage device.
Figure 5:
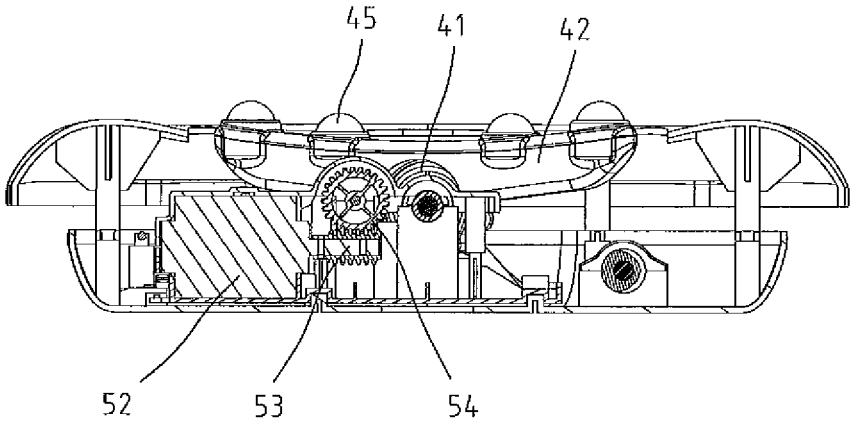
FIG. 5 is a cross-sectional view taken along line V-V in FIG. 3 showing the massage device.
Figure 6:
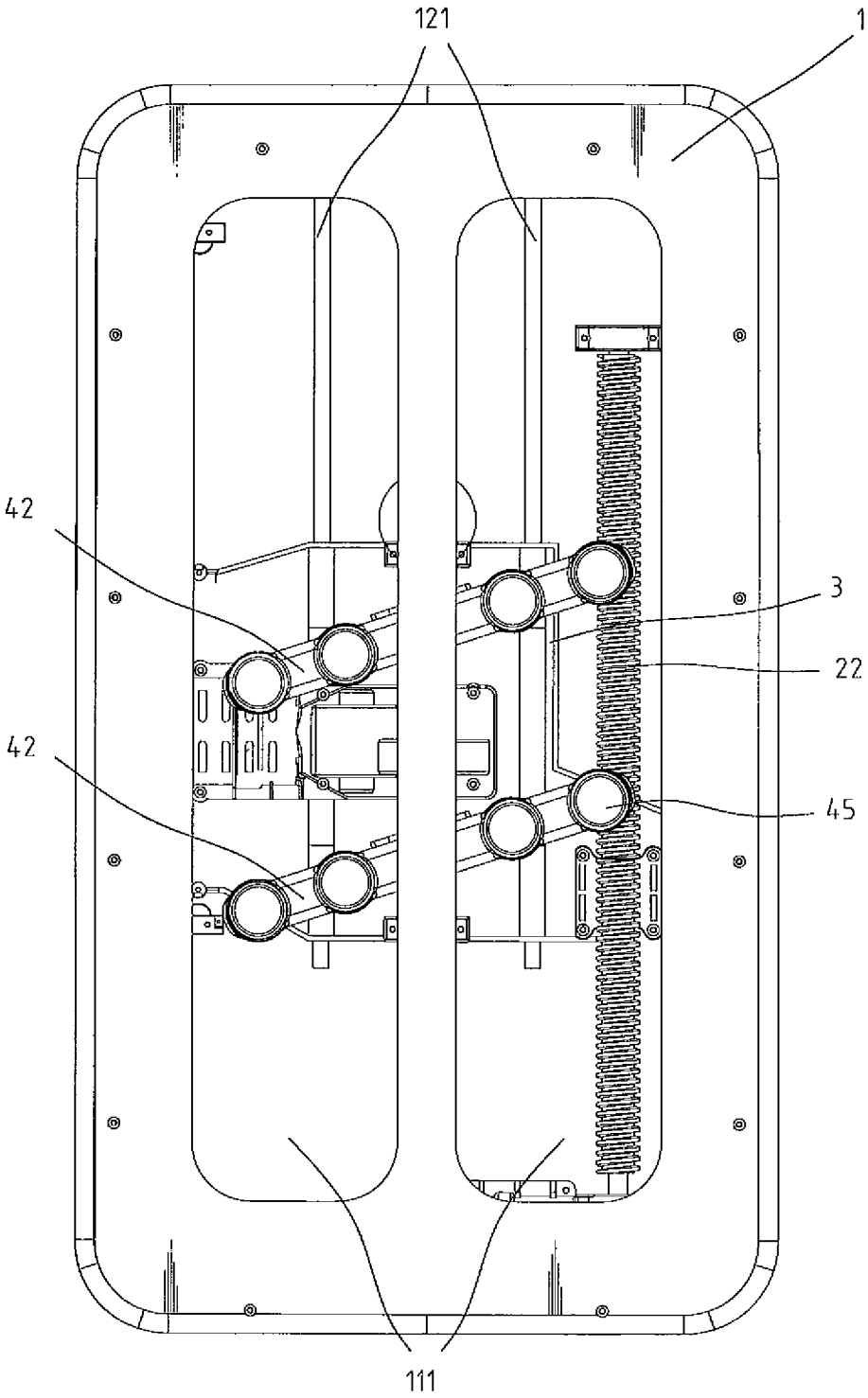
FIG. 6 is a top view showing the massage device, wherein sway arms are in a direction different from that of FIG. 3.

While the massage seat 3 is moving, the rotating axle of the motor 52 drives the worm shaft 53 to rotate and the worm shaft 53 drives the dual gear 54 to rotate. Driven by the dual gear 54, the transmission gear 55 causes the rotary axle 51 and the sway wheels 41 coupled at the two ends thereof to rotate. Each sway wheel 41 is configured similar to a cam with the slanted side surface. A circumferential margin of the slanted surface of the sway wheel 41 contacts with the inner ridge of the hole 421. When the sway wheel 41 rotates, the slanted surface of the sway wheel 41 presses against the inner ridge of the hole 421, causing the two ends of each sway arm 42 to alternately sway transversely and inclinedly relative to the direction of the rotary axle 51 as shown in FIGS. 3 and 6. FIG. 3 shows the sway arms 42 in the upper-left to lower-right direction (i.e., transversely and inclinedly) with respect to the direction of the rotary axle 51 and FIG. 6 shows the sway arms 42 swaying to the upper-right to lower-left direction (i.e., transversely and inclinedly) with respect to the direction of the rotary axle 51. The swaying movement of the sway arm 42 causes each massage ball to spin within the boundary of the restricting opening 4221 on the cover 422. When the massage seat 3 is in movement, the massage members 45 (massage balls) protrude through the openings 111 of the upper cover 11.

Figure 2:
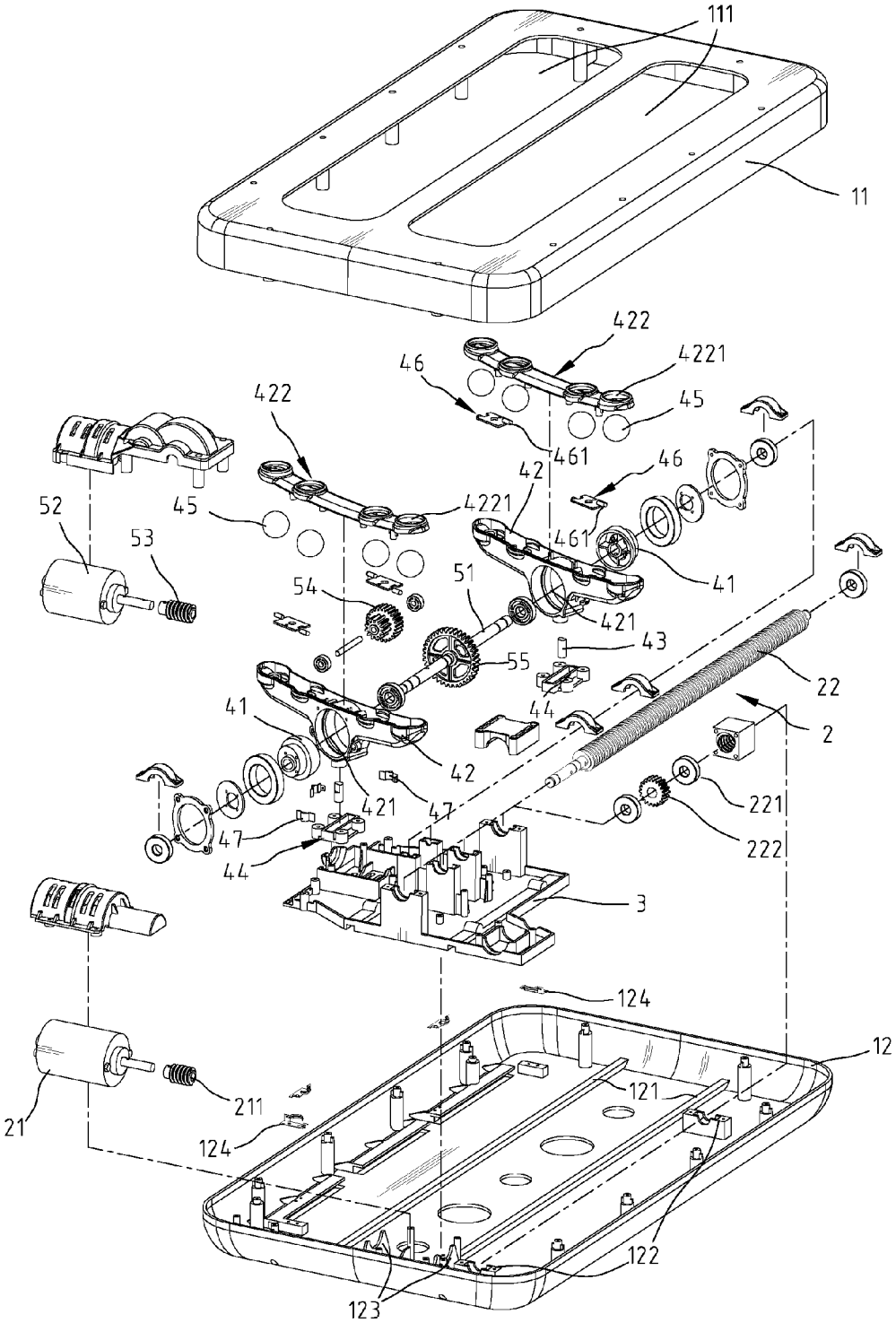
FIG. 2 is an exploded view showing an outer housing, a first transmission mechanism, a second transmission mechanism, a massage seat and a massage unit of the massage device according to the embodiment of the present invention.
Figure 7:
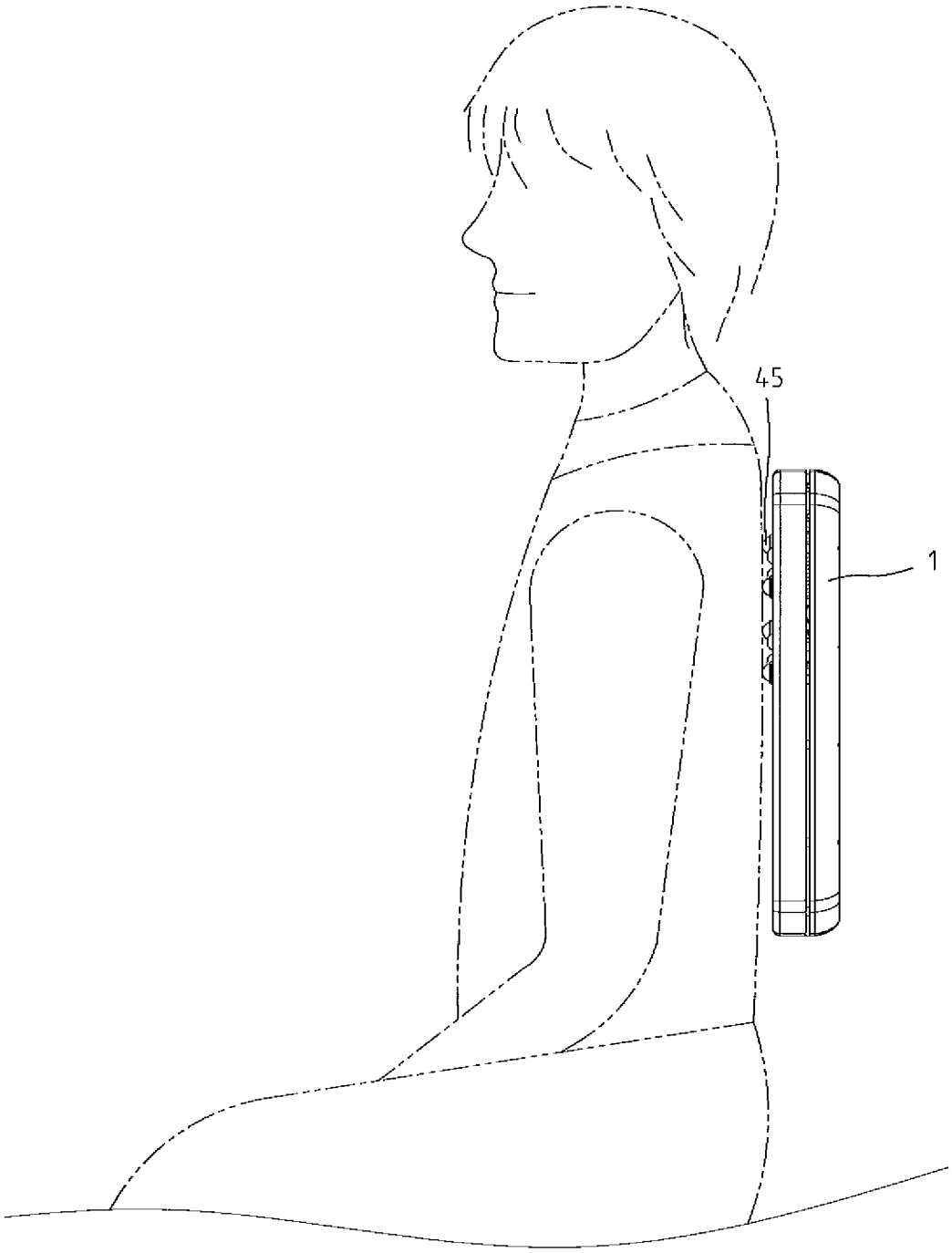
FIG. 7 is a schematic view showing the massage device used to massage a user's back.

The structure described herein may be adaptable for foot massage devices, back massage devices, leg massage devices, or the like. FIG. 7 illustrates a use configuration of an embodiment exemplary implemented as a back massage device. Referring to FIGS. 2, 6 and 7, owing to the design of the restricting switch (the first contact tabs 124 and second contact tabs 47), the massage seat 3 is operable to perform reciprocating movements on the user's back. The sway arms 42 sway and the massage members 45 spin. Therefore the massage device provides kneading and pressing on the user's back. Moreover, the lamp circuits 46 are powered on to activate the light-emitting elements 461 and the thermal resistors, thereby producing light and heat. The illumination produced from the light-emitting elements 461 can be transmitted through the covers 422 of the sway arms 4, and amplified and scattered through the massage members 45, thereby providing a vivid ornamentation of the massage device. Further, the produced heat can relax the user's body.

Although the present invention has been described with reference to the preferred embodiment thereof it is apparent to those skilled in the alt that a variety of modifications and changes may be made without departing from the scope of the present invention which is intended to be defined by the appended claims.

What is claimed is:

1. A massage device comprising:

an outer housing including an upper cover and a lower cover, wherein the upper cover has at least one opening, and the lower cover includes two sliding tracks and a plurality of supporting brackets;

a massage seat having a guide slot and movably mounted on the sliding tracks;

a first transmission mechanism mounted on the lower cover to drive the massage seat to move;

a second transmission mechanism including a rotary axle and mounted on the massage seat; and at least one massage unit mounted on the massage seat; the massage unit comprising a sway wheel assembled on the rotary axle, a sway arm having a circular hole in which the sway wheel is received, a positioning rod having an upper end inserted into a lower end of the sway arm and a free end inserted rotatably in the guide slot, and a plurality of massage members provided on a top of the sway arm; the sway wheel including one slanted side surface; a circumferential surface of the hole of the sway arm extending an inner ridge corresponding to the sway wheel;

wherein, the first transmission mechanism drives the massage seat to reciprocate moving along the sliding tracks in the outer housing; the second transmission mechanism drives the rotary axle and the sway wheel in rotation, the slanted side surface of the rotating sway wheel presses against the inner ridge of the hole of the sway arm, thereby driving the sway arm to sway left and right, transversely and inclinedly with respect to an axial direction of the rotary axle.

2. The massage device according to claim 1, wherein an inner surface of the lower cover comprises a microcontroller and a plurality of spaced-apart first contact tabs, and the massage seat includes a plurality of spaced-apart second contact tabs thereon, when predetermined first contact tabs come into contact with predetermined second contact tabs, the microcontroller causes the first transmission mechanism to move in a reverse direction so that the massage seat moves in an opposite direction.

3. The massage device according to claim 1, wherein the first transmission mechanism comprises a screw rod placed on the supporting brackets on the lower cover, the screw rod is engaged with a screw nut securely coupled with the massage seat, one end of the screw rod is engaged with a transmission gear, the transmission gear is engaged with a worm shaft coupled with a motor provided on the lower cover.

4. The massage device according to claim 1 comprising two sets of the massage units.

5. The massage device according to claim 4, wherein the second transmission mechanism comprises at least one motor disposed on the massage seat, the motor coupled with a worm shaft, the worm shaft drives a transmission gear assembled on the rotary axle, so that the rotary axle is capable of swaying the sway arm.

6. The massage device according to claim 5, wherein the sway arm has a hollow structure adapted to receive the massage members, the sway arm further includes a cover having a plurality of restricting openings corresponding to the massage members.

7. The massage device according to claim 6, wherein the hollow structure of the sway arm accommodates at least one lamp circuit therein.

8. The massage device according to claim 7, wherein the massage members and the cover of the sway arm are made of a material that is pervious to light.

9. The massage device according to claim 8, wherein the massage members are spherical balls and capable of spinning in the hollow structure of the sway arm.

10. The massage device according to claim 6, wherein the hollow structure of the sway arm accommodates a thermal resistor therein.

11. The massage device according to claim 1, wherein the second transmission mechanism comprises at least one motor disposed on the massage seat, the motor coupled with a worm shaft, the worm shaft drives a transmission gear assembled on the rotary axle, so that the rotary axle is capable of swaying the sway arm.

12. The massage device according to claim 11, wherein the sway arm has a hollow structure adapted to receive the massage members, the sway arm further includes a cover having a plurality of restricting openings corresponding to the massage members.

13. The massage device according to claim 12, wherein the hollow structure of the sway arm accommodates at least one lamp circuit therein.

14. The massage device according to claim 13, wherein the massage members and the cover of the sway arm are made of a material that is pervious to light.

15. The massage device according to claim 14, wherein the massage members are spherical balls and capable of spinning in the hollow structure of the sway arm.

16. The massage device according to claim 12, wherein the massage members are spherical balls and capable of spinning in the hollow structure of the sway arm.

17. The massage device according to claim 12, wherein the hollow structure of the sway arm accommodates a thermal resistor therein.

* * * * *